United States Patent [19]

Mayhew

[11] 3,977,842

[45] Aug. 31, 1976

[54] PRODUCT AND PROCESS

[75] Inventor: John T. Mayhew, Toronto, Ohio

[73] Assignee: National Steel Corporation, Pittsburgh, Pa.

[22] Filed: June 16, 1970

[21] Appl. No.: 46,825

Related U.S. Application Data

[63] Continuation of Ser. No. 757,522, Aug. 27, 1968, abandoned, which is a continuation of Ser. No. 375,264, June 15, 1964, abandoned.

[52] U.S. Cl. ..... 29/196.5; 427/349; 427/321; 427/374; 427/433; 118/63; 118/419; 118/69

[51] Int. Cl.[2] ..... C23C 1/02

[58] Field of Search ..... 117/102 M, 114 R, 114 A, 117/114 B, 114 C; 427/320, 321, 374, 398, 349, 431, 432, 433; 29/196.5, 196.2; 148/31.5

[56] References Cited

UNITED STATES PATENTS

| | | | |
|---|---|---|---|
| 287,076 | 10/1883 | Young | 427/349 |
| 811,854 | 2/1906 | Lee | 427/349 |
| 1,672,526 | 6/1928 | Hawkins | 117/114 U X |
| 2,063,721 | 12/1936 | Bradley | 118/423 |
| 2,111,826 | 3/1938 | Waltman et al. | 427/377 |
| 2,390,007 | 11/1945 | Sherman | 118/63 X |
| 2,986,808 | 6/1961 | Schnedler | 427/436 |
| 3,010,844 | 11/1961 | Klein et al. | 427/320 |
| 3,056,694 | 10/1962 | Mehler et al. | 427/374 |
| 3,078,555 | 2/1963 | McFarland | 29/196.5 |
| 3,112,213 | 11/1963 | Lusa | 427/209 |
| 3,177,088 | 4/1965 | Sievert | 427/178 |
| 3,190,768 | 6/1965 | Wright | 427/46 |
| 3,260,577 | 7/1966 | Mayhew | 29/183.5 |

*Primary Examiner*—Ralph S. Kendall
*Attorney, Agent, or Firm*—Shanley, O'Neil and Baker

[57] ABSTRACT

Steel strip at around 1000°F. or higher is run into a galvanizing pot maintained at a higher than conventional temperature to cause alloying of the iron with the spelter on the surfaces of the strip, the strip being passed through a zone of cooled molten spelter before being withdrawn from the galvanizing bath, the steel strip issuing from the bath having an inner iron-zinc alloy coating and an outer molten spelter coating, substantially all the molten spelter coating being removed from at least one surface of the strip by a stream of gas under pressure. Where molten galvanizing spelter coating is left on one side, the weight of the molten layer averages at least 1/10th of an ounce per square foot of coated surface.

24 Claims, 2 Drawing Figures

INVENTOR.
JOHN T. MAYHEW
BY Shanley and O'Neil
ATTORNEYS

PRODUCT AND PROCESS

RELATED PATENT APPLICATIONS

This application is a continuation of applicant's application Ser. No. 757,522 filed Aug. 27, 1968 (now abandoned) which in turn was a continuation of application Ser. No. 375,264 filed June 15, 1964 (now abandoned).

DESCRIPTION OF THE PREFERRED VARIANTS OF THE INVENTION AND PREFERRED EMBODIMENTS OF THE INVENTION

This invention is concerned with novel coated steel strip and includes novel continuous-strip methods and apparatus for producing novel coated steel product.

One of the primary objectives of the invention is continuous-strip production of steel with a novel, highly corrosion-resistant coating having a smooth finish suitable for painting, as produced on the line, and formable to the same extent as the base metal without cracking.

Figure 1:
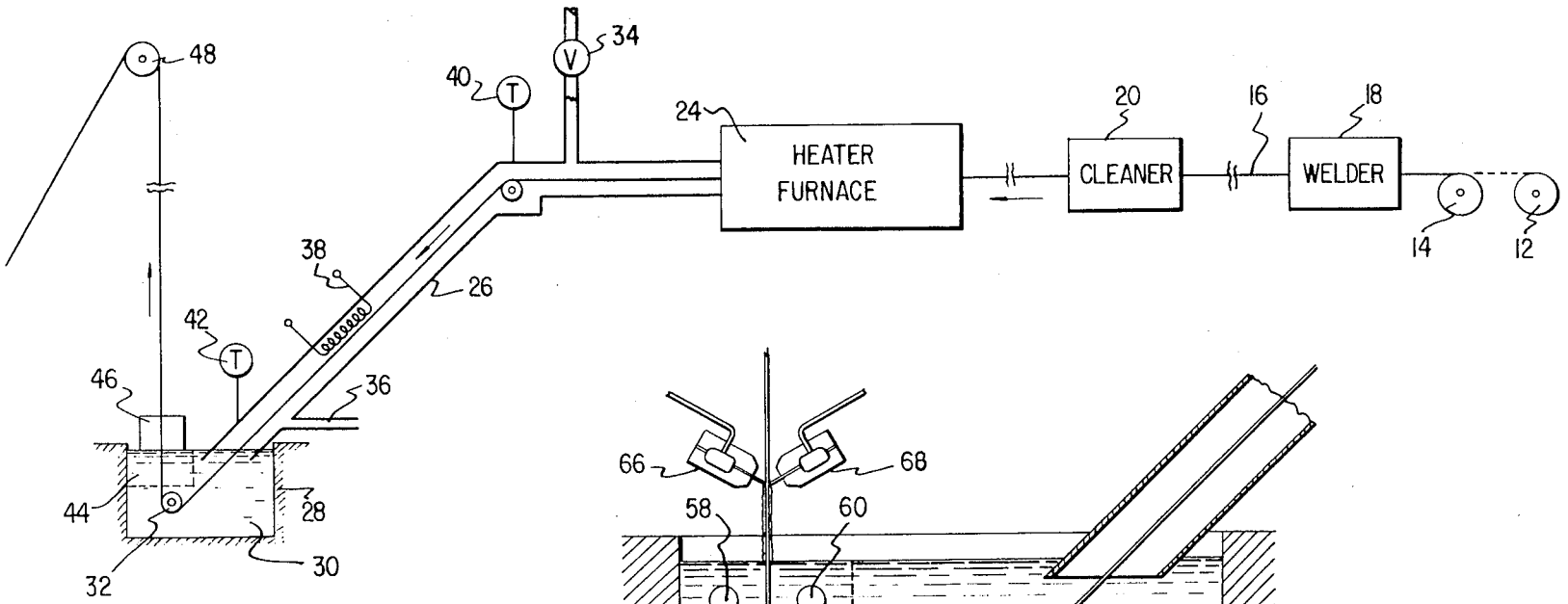
Figure 2:
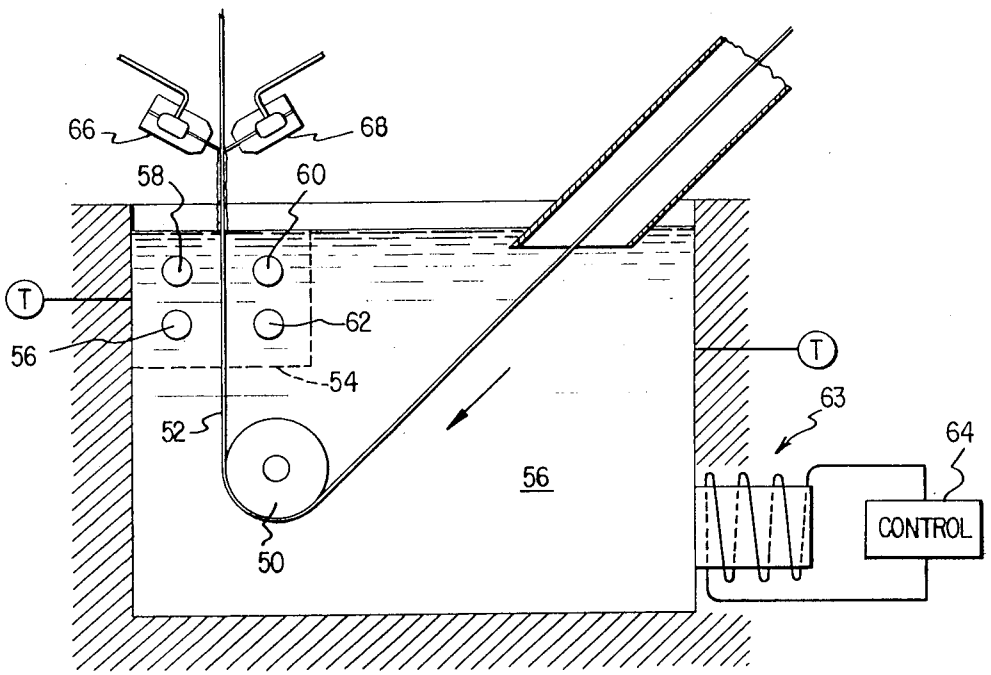

In describing the invention, reference will be had to the accompanying drawings in which:

FIG. 1 is a schematic diagram of a continuous-strip line embodying the invention, and FIG. 2 is a schematic diagram of a portion of a continuous-strip line embodying the invention.

Referring to FIG. 1, steel from coils 12 and 14 is formed into continuous strip 16 at welder 18. Ordinarily, the strip is cleaned or otherwise treated at unit 20 and then heated in furnace heater 24 which can be a continuous annealer.

The heated strip is fed through atmosphere-controlled chute 26 to coating pot 28. Chute 26 leads into and extends beneath the surface of bath 30 so that strip 16 enters the bath from a controlled atmosphere. Bath 30 can be conventional galvanizing spelter with up to 0.30% aluminum additions, impurity level percentages of lead, tin, antimony, cadmium, etc., and the balance zinc about 99% (by weight).

In accordance with the teachings of the invention, a controlled iron-zinc alloy is formed having a uniform, smooth finish suitable for painting without bonderizing or other treatment and formable to the same extent as the base metal without cracking. In order to meet this objective and produce the desired type of coating, iron from the steel must be alloyed with zinc out of contact with an oxidizing atmosphere and the alloy produced must be brought to the surface of the finished product. The invention also teaches unique modifications of existing continuous-strip galvanizing lines which permit manufacture of this novel coating and product on these lines.

Referring to FIG. 1, strip 16 and bath 30 are raised in temperature above what is ordinarily considered optimum coating temperatures. This is practicable because of special cooling apparatus, specially located. Bath 30, except for a defined minor portion specially located at its exit side, is maintained at a temperature of approximately 900°F. to approximately 950°F. or higher. This temperature is maintained by strip 16 or by strip 16 and other heat sources.

The desired iron-zinc alloy is formed only while strip 16 is submerged in bath 30, roughly between entry of strip 16 into bath 30 and its passage around sink roll 32. One theory is that desirable alloy is produced primarily during the period that the temperature of strip 16 approaches and reaches the temperature of the major portion of bath 30. Alloying is controlled mainly by the heat content of strip 16 which is influenced by the gage of the strip. Heavy-gage materials generally carry more heat and produce heavier coating weights, e.g. around 0.3 to approximately 0.35 ounce per square foot of surface can be formed. The light-gage materials produce alloy coatings around 0.15 to 0.2 ounce per square foot of surface.

Strip 16 should be introduced to bath 30 at a temperature around 1000°F. or higher. The strip is brought to required temperature on the line in heater 24. Strip transfer into pot 28 is controlled in chute 26. This includes control of atmosphere in chute 26 to prevent oxidation of strip 16; atmosphere control means, such as conduits 34 and 36, are provided for this purpose. Control of strip transfer also includes control of heat losses; chute 26 can be insulated for this purpose and can include heat control means 38. The temperature of the strip 16 as measured at temperature sensors 40 and 42 is maintained around 1000°F. or higher. Strip 16 travels around sink roll 32 toward cooled spelter zone 44. Upon passage through zone 44, the strip travels through coating control means 46 toward top roll 48.

Reviewing the embodiment described thus far, strip is heated in a continuous-strip line to a temperature around 1000°F. or higher. The strip is transferred from the line heating means to the coating pot through a controlled atmosphere and is introduced into molten galvanizing spelter at a temperature around 1000°F. or higher. The temperature of the bath is maintained around 900°F. to around 950°F. These steps combine to control alloy formation of bath zinc with strip iron while the steel strip is submerged beneath the surface of the bath.

The iron-zinc alloy formation is controlled quantitatively by control of temperature factors to produce coating weights of approximately 0.15 to approximately 0.35 ounce per square foot on each surface of the steel strip. Alloy formation is controlled qualitatively by such factors as production out of contact with an oxidizing atmosphere, temperature and termination of alloying before contact with an oxidizing atmosphere.

Referring to FIG. 2, after passage of the strip around the sink roll 50 in bath 51, iron-zinc alloy coated strip 52 travels into a cooled spelter zone 54. Galvanizing bath cooler means 56, 58, 60 and 62 cool the spelter in zone 54 and are used to control the temperature of this zone. Details of a suitable bath cooler may be found in the copending application entitled "Hot-Dip Metal Coating" by John T. Mayhew, Ser. No. 374,953, filed concurrently with the present application, now abandoned, and which is incorporated herein by reference. Briefly, however, one or more submerged coolant conduits, positioned near the travel path of strip approaching exit from the bath, are used to cool a portion of the bath contiguous with the travel path of the strip in the exit zone.

The cooled spelter zone is ordinarily held to a temperature around 840°F. to 860°F. with any variations below this range being dependent on the product. This zone is ordinarily not cooled below 800°F. and a temperature around 820°F. can be used when cooling requirements dictate, e.g. for the heavier gages. The remainder of bath 51 is then maintained at a temperature of approximately 890°F to approximately 950°F.

An important function of the galvanizing bath cooler is to cool the molten spelter applied to iron-zinc alloy coated strip and to cool the steel base metal. In this way, the desired iron-zinc alloying is terminated before contact of the coated strip with ambient atmosphere.

After termination of alloying, the iron-zinc alloy coating must be exposed as a finished surface of the product. Strip 52, upon exit from the cooled galvanizing spelter zone 54 is coated with an inner iron-zinc alloy coating and an outer galvanizing spelter coating. The iron-zinc alloy is made the finished surface of the product by precisely controlling removal of the molten galvanizing spelter coating from the solid iron-zinc alloy coating. Such removal is controlled by gas barrier (jet) coating control elements 66 and 68 which, in accordance with one embodiment of the invention, remove the galvanizing spelter coating entirely from both surfaces of the iron-zinc alloy coated strip.

The gas barrier or jet coating control elements and process use heated gas which is directed against the moving strip so as to act as a barrier to passage of molten coating. The process and apparatus are described in detail in copending application Ser. No. 282,474, filed May 22, 1963, now abandoned, entitled "Coating Method, Apparatus and Coated Product" by John T. Mayhew. To date no other coating control apparatus or method has been found to function satisfactorily to remove, for practical purposes, substantially all the galvanizing spelter in a commercial operation. Iron-zinc alloy shows on the entire surface after passage through gas barrier apparatus. Mechanical rolls, wipers, or scrapers, as presently developed, leave marks on the strip and patches of galvanizing spelter which cause commercial rejects and produce a differing coating while the gas barrier (jet) method and apparatus leave a smooth-finish, uniform, galvanize spelter-free, iron-zinc alloy surface.

The bath cooling apparatus serves other important functions such as reducing iron dissolution in the galvanizing spelter applied to the strip 52. The temperature of the galvanizing spelter on strip 52 upon exit from zone 54 is at or near the temperature of zone 54. If high temperature galvanizing spelter were present in zone 54, iron dissolution and dross formation would make it impossible to produce the smooth coat produced by the present invention. Without this cooling feature, a gritty, uneven, unacceptable surface would be formed and it would not be practicable to maintain the remainder of the bath at the temperature level required to produce the desired alloy.

With certain gages of steel strip, especially among the lighter gages, heat is required to be added to the bath from one or more heat sources, such as bath heater unit 63. Bath temperature can be maintained at the desired level near 900°F. to around 950°F. by control 64 which may be coordinated automatically with the temperature of the strip and/or the temperature of the galvanizing bath spelter.

Iron content in the iron-zinc alloy formed in accordance with the teachings of the invention varies around 10% to 15% by weight of the alloy. Corrosion tests on this novel coating for steel strip rate this coating above other commercially available steel strip coatings of equal and heavier coating weights. Salt spray tests of over 100 hours and up to 165 hours have been held without showing rust. It is believed that 0.6 ounce per square foot total both surfaces of steel strip, of this novel coating is the equal of 1.5 ounces per square foot total both surfaces of steel strip of regular galvanize spelter coating.

This novel coating is uniform and very smooth. None of the rough surface associated with conventional galvanized and related commercially available product is present. The coating is adherent throughout its depth, is solid, and is not powdery.

The coating adhesion is excellent. The coating can be formed to the same extent as the base metal without crumbling or cracking. All standard tests, such as the Pittsburgh Lockseam Test, have been performed on this product without in any way disturbing coating adhesion.

Also, this novel coated product welds like uncoated steel. All standard welding tests show little or no difference in weldability between this product and uncoated steel. None of the disadvantages of electrode tip pick-up, experienced with other coated steel products, are present. Spot welding is facilitated by a quicker concentration of heat than with conventional coated steel product.

Further, as produced on the line, this novel coated product takes most conventional painting or coating treatments applied to cold rolled steel so that it can be worked in conjunction with cold rolled stock. Another advantage of the product is its ability to take heat treatment. For example, in production of drawing stock for automotive uses, this product can be heated to temperatures up to 1000°F. and higher without damage to the protection provided by the coating or damage to the coating itself. This novel alloy coating has a melting temperature above 1000°F.

Differentially coated steel strip is another unique product available with the teachings of the invention. Upon exit of the strip from a cooled spelter zone, the jet process is used to remove the galvanizing spelter coating entirely from one surface of the strip and to control the coating weight of galvanize spelter on the remaining surface of the iron-zinc alloy coated steel strip. A thin controlled coating of galvanizing spelter on one side of the iron-zinc alloy coated strip is produced which presents a bright, smooth surface.

The iron-zinc alloy inner surface coating of the differentially coated product is as described earlier. That is, approximately 0.15 to approximately 0.35 ounce per square foot of iron-zinc alloy coating are present. A galvanizing spelter coating of approximately 0.10 to approximately 0.50 ounce per square foot is produced on one surface of the product while the iron-zinc alloy finish is produced on the remaining surface. This can be carried out by setting the hot gas pressure for jet nozzle 66 to remove all molten coating from one surface of strip 52 and by setting the hot gas pressure for jet nozzle 68 to leave a controlled amount of molten galvanizing spelter.

The galvanize spelter finish on the differentially coated product is unusually smooth for galvanized product. The roughness associated with spangle boundaries is not present. This smoothness is believed to be due, at least in part, to the thinness of the galvanize spelter coating. Such thin coating is made possible because of the previously described cooling feature. Without this feature such a thin coating would alloy, at least in part, in the atmosphere after exit from the coating control means.

Various novel processes, structures, and products have been described in disclosing the invention. In view of such disclosure, modifications of the described embodiments will be possible for those having skill in the art. Therefore, it is to be understood that the scope of the present invention is to be determined by the appended claims.

I claim:

1. Continuous-strip method for producing coated steel strip comprising a. forming a molten galvanizing bath containing aluminum additions up to 0.30% by weight, b. introducing heated steel strip into the molten galvanizing bath, the strip entering the bath being at a temperature higher than the temperature of the molten spelter in the bath thereby adding heat to the bath, c. maintaining molten galvanizing spelter in the bath at a temperature of approximately 890°F. to approximately 950°F., d. moving the heated strip through the bath toward an exit side of the bath, e. forming an iron-zinc alloy coating on the moving strip by contacting the moving strip with molten spelter at a temperature of approximately 890°F. to approximately 950°F., f. delivering the strip from the exit side of the bath, the delivered strip having an inner iron-zinc alloy coating and an outer molten galvanizing spelter coating, g. directing gas under pressure against at least one side of the coated steel strip upon delivery of the coated steel strip from the molten galvanizing bath to remove the molten galvanizing spelter coating from the iron-zinc alloy coated steel strip on the one side, h. subjecting a portion of the molten galvanizing spelter in the bath to heat exchange contact with a cooling fluid to cool said portion of the bath, the cooled portion of the bath being located at the strip exit side of the bath, and i. delivering the steel strip from the molten galvanizing bath upon passage through the cooled portion.

2. The method of claim 1 in which the strip in limitation (b) is at a temperature of approximately 1000°F. or higher.

3. The method of claim 3 in which the gas under pressure is a hot gas.

4. The method of claim 3 in which the conditions of step (e) are such that the iron-zinc alloy coating on the steel trip has a weight of approximately 0.3 to approximately 0.7 ounce per square foot of strip.

5. The method of claim 4 comprising directing gas under pressure against the other side of the coated strip to control the coating weight of the molten galvanizing spelter remaining on the other side of the strip between the limits of approximately 0.1 and approximately 0.5 ounce per square foot.

6. The method of claim 5 comprising directing gas under pressure against the other side of the coated strip upon delivery of the coated strip from the molten galvanizing bath to remove the molten galvanizing spelter coating from the iron-zinc alloy coated strip on the other side.

7. The method of claim 2 in which the conditions of step (e) are such that the iron-zinc alloy coating on the steel strip has a weight of approximately 0.3 to approximately 0.7 ounce per square foot of strip.

8. The method of claim 7 comprising directing gas under pressure against the other side of the coated strip to leave a controlled coating weight of the molten galvanizing spelter remaining on the other side of the strip.

9. The method of claim 2 comprising directing gas under pressure against the other side of the coated strip upon delivery of the coated strip from the molten galvanizing bath to remove the molten galvanizing spelter coating from the iron-zinc alloy coated strip on the other side.

10. The method of claim 3 comprising directing gas under pressure against the other side of the coated strip to control the coating weight of the molten galvanizing spelter remaining on the other side of the strip between the limits of approximately 0.1 and approximately 0.5 ounce per square foot.

11. The method of claim 2 in which the strip as so delivered has thereon a weight of inner iron-zinc alloy coating of approximately 0.3 to approximately 0.7 ounce per square foot of strip and a smooth, even, non-gritty, outer molten galvanizing spelter coating.

12. The method of claim 2 in which the cooled portion of the bath is located at the strip exit side of the bath and the steel strip is delivered from the molten galvanizing bath upon passage through the cooled portion, the strip as so delivered having thereon a weight of inner iron-zinc alloy coating of approximately 0.3 to approximately 0.7 ounce per square foot of strip and a smooth, even, non-gritty, outer molten galvanizing spelter coating.

13. The method of claim 1 in which the gas under pressure is a hot gas.

14. The method of claim 1 in which the conditions of step (e) are such that the iron-zinc alloy coating on the steel strip has a weight of approximately 0.3 to approximately 0.7 ounce per square foot of strip.

15. The method of claim 14 comprising directing gas under pressure against the other side of the coated strip to control the coating weight of the molten galvanizing spelter remaining on the other side of the strip between the limits of approximately 0.1 and approximately 0.5 ounce per square foot.

16. The method of claim 14 comprising directing gas under pressure against the other side of the coated strip upon delivery of the coated strip from the molten galvanizing bath to remove the molten galvanizing spelter coating from the iron-zinc alloy coated strip on the other side.

17. The method of claim 1 comprising directing gas under pressure against the other side of the coated strip upon delivery of the coated strip from the molten galvanizing bath to remove the molten galvanizing spelter from the iron-zinc alloy coated strip on the other side.

18. The method of claim 1 in which the conditions of step (e) are such that the iron-zinc alloy coating on the steel strip has a weight of approximately 0.3 to approximately 0.7 ounce per square foot of strip.

19. The method of claim 1 comprising directing gas under pressure against the other side of the coated strip to control the coating weight of the molten galvanizing spelter remaining on the other side of the strip between the limits of approximately 0.1 and approximately 0.5 ounce per square foot.

20. The method of claim 18 comprising directing gas under pressure against the other side of the coated strip upon delivery of the coated strip from the molten galvanizing bath to remove the molten galvanizing spelter coating from the iron-zinc alloy coated strip on the other side.

21. The method of claim 7 comprising directing gas under pressure against the other side of the coated strip to control the coating weight of the molten galvanizing spelter remaining on the other side of the strip between the limits of approximately 0.1 and approximately 0.5 ounce per square foot.

22. The method of claim 1 in which the strip as so delivered has thereon a weight of inner iron-zinc alloy coating of approximately 0.3 to approximately 0.7 ounce per square foot of strip and a smooth, even, non-gritty, outer molten galvanizing spelter coating.

23. A steel product produced in accordance with the method of claim 19.

24. A steel product produced in accordance with the method of claim 31.

* * * * *

UNITED STATES PATENT OFFICE

CERTIFICATE OF CORRECTION

Patent No. 3,977,842 Dated August 31, 1976

Inventor(s) John T. Mayhew

It is certified that error appears in the above-identified patent and that said Letters Patent are hereby corrected as shown below:

Col. 5, line 45, "3" should read -- 2 --;

Col. 5, line 48, "trip" should read -- strip --;

Col. 6, line 9, "3" should read -- 2 --;

Col. 6, line 31, "1" should read -- 13 --;

Col. 6, line 57, "1" should read -- 18 --;

Col. 7, line 1, "7" should read -- 1 --;

Col. 8, line 7, "31" should read -- 20 --.

Col. 6, Claim 12 should read as follows:

-- 12. The method of claim 3 in which the strip as so delivered has thereon a weight of inner iron-zinc alloy coating of approximately 0.3 to approximately 0.7 ounce per square foot of strip and a smooth, even, non-gritty, outer molten galvanizing spelter coating. --

Signed and Sealed this

Twelfth Day of April 1977

[SEAL]

*Attest:*

RUTH C. MASON
*Attesting Officer*

C. MARSHALL DANN
*Commissioner of Patents and Trademarks*